US008522695B2

(12) United States Patent
Ellegaard

(10) Patent No.: US 8,522,695 B2
(45) Date of Patent: Sep. 3, 2013

(54) ELECTRICALLY ADJUSTABLE PIECE OF FURNITURE

(75) Inventor: Kent Ellegaard, Augustenborg (DK)

(73) Assignee: Linak A/S, Nordborg (DK)

( * ) Notice: Subject to any disclaimer, the term of this patent is extended or adjusted under 35 U.S.C. 154(b) by 1103 days.

(21) Appl. No.: 12/226,969

(22) PCT Filed: May 1, 2007

(86) PCT No.: PCT/DK2007/000210

§ 371 (c)(1),
(2), (4) Date: Nov. 3, 2008

(87) PCT Pub. No.: WO2007/124754

PCT Pub. Date: Nov. 8, 2007

(65) Prior Publication Data

US 2009/0078167 A1 Mar. 26, 2009

(30) Foreign Application Priority Data

May 1, 2006 (DK) ..... 2006 00611

(51) Int. Cl.
*A47B 9/00* (2006.01)

(52) U.S. Cl.
USPC ..... 108/144.11; 108/20

(58) Field of Classification Search
USPC ..... 108/147, 20, 144.11; 248/188.2, 248/188.5
See application file for complete search history.

(56) References Cited

U.S. PATENT DOCUMENTS 3,334,951 A * 8/1967 Douglass, Jr. et al. ..... 312/209
4,440,096 A * 4/1984 Rice et al. ..... 108/3
4,714,025 A 12/1987 Wallin et al.
5,050,941 A * 9/1991 Dahnert et al. ..... 312/201
5,323,695 A * 6/1994 Borgman et al. ..... 108/147
5,461,974 A * 10/1995 Reneau ..... 108/147
5,917,165 A * 6/1999 Platt et al. ..... 200/600
6,403,904 B1 * 6/2002 Schilling ..... 200/600

(Continued)

FOREIGN PATENT DOCUMENTS

DE 29818567 3/1999
DE 19836670 2/2000

(Continued)

OTHER PUBLICATIONS

Machine translation into English of EP 1470766 from espace.com.*

(Continued)

*Primary Examiner* — Darnell Jayne
*Assistant Examiner* — Daniel Rohrhoff
(74) *Attorney, Agent, or Firm* — Dykema Gossett PLLC

(57) ABSTRACT

An electrically adjustable piece of furniture, such as a table or armchair comprising at least one actuator and/or lifting column driven by an electric motor for adjustment of the piece of furniture. The adjustment is executed via a control with touch keys. It is characteristic that touch keys are located on the back of an element in the piece of furniture, and that indications for the touch keys are provided on a visible and accessible surface above the touch keys. The touch keys can, however, also be inlayed in an element of the piece of furniture providing possibility for operation from several sides of the element. This provides many variation possibilities for designing the control. Very simply, the indications can merely be painted directly onto the surface, while they, more sophisticatedly, can be inlayed symbols in wood, metal etc., alternatively be a plate mounted on or inlayed in the element.

12 Claims, 3 Drawing Sheets

(56) References Cited

U.S. PATENT DOCUMENTS

Figure 1:
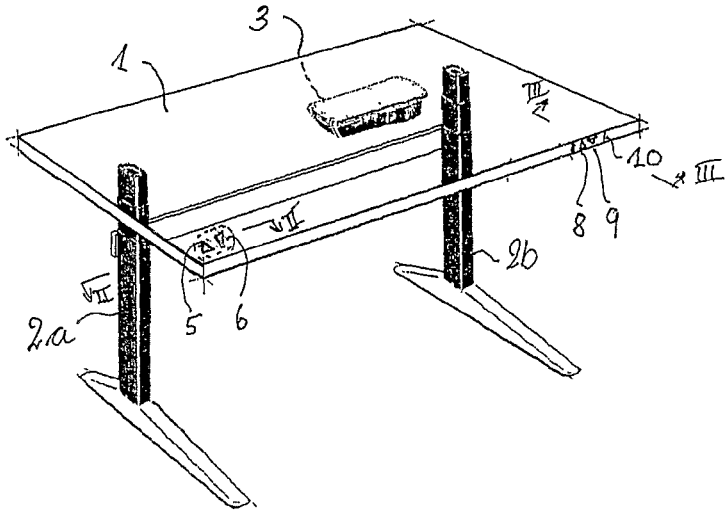

| | | | | |
|---|---|---|---|---|
| 6,429,668 | B1 * | 8/2002 | Billen et al. | 324/699 |
| 6,595,144 | B1 * | 7/2003 | Doyle | 108/147 |
| 6,765,159 | B1 * | 7/2004 | Uebelein et al. | 200/17 R |
| 7,048,238 | B2 * | 5/2006 | Rotondi | 248/125.8 |
| 7,163,184 | B2 | 1/2007 | Nielsen | |
| 7,265,747 | B2 * | 9/2007 | Martin | 345/173 |
| 7,538,284 | B2 * | 5/2009 | Nielsen et al. | 200/296 |
| 7,652,230 | B2 * | 1/2010 | Baier | 219/483 |
| 7,908,981 | B2 * | 3/2011 | Agee | 108/147 |
| 2002/0162921 | A1 * | 11/2002 | Rotondi | 248/125.8 |
| 2003/0067451 | A1 * | 4/2003 | Tagg et al. | 345/174 |
| 2003/0085597 | A1 | 5/2003 | Ludeke | |
| 2006/0061315 | A1 * | 3/2006 | Schmidt et al. | 318/568.1 |
| 2006/0066586 | A1 * | 3/2006 | Gally et al. | 345/173 |
| 2007/0170826 | A1 * | 7/2007 | Tsao | 312/223.3 |
| 2008/0245279 | A1 * | 10/2008 | Pan | 108/144.11 |
| 2009/0078167 | A1 * | 3/2009 | Ellegaard | 108/21 |
| 2011/0061570 | A1 * | 3/2011 | Klinke et al. | 108/20 |

FOREIGN PATENT DOCUMENTS

| | | |
|---|---|---|
| EP | 0341358 | 11/1989 |
| EP | 1470766 | 10/2004 |
| WO | 2004080752 | 9/2004 |
| WO | WO 2005073634 A1 * | 8/2005 |

OTHER PUBLICATIONS

English Abstract of DE19836670.

English Abstract of EP1470766.

* cited by examiner

ELECTRICALLY ADJUSTABLE PIECE OF FURNITURE

BACKGROUND OF THE INVENTION

1. Field of the Invention

The present invention relates to an electrically-adjustable piece of furniture, such as a table, armchair or bed.

2. The Prior Art

For the sake of convenience, the explanation of the invention departs in height adjustable tables driven by an electric motor, but it is emphasized that the invention exists for any of the types of furniture such as tables, armchairs and beds. Height adjustable tables, equipped with actuators or lifting columns driven by electric motors, can be adjusted via a control panel with pushbuttons. Design and mounting of the control panel has proven not to be unproblematic as it must be easy to operate, and may, on the other hand, not be positioned where it is exposed to damage. A position where it protrudes from the table top is unsuitable as it is exposed to damage both during everyday use as well as during storage, shipping and moving. Such control panels are for instance known from DE 298 18 567 to Vibradorm GmbH and WO 03/093619 to Linak A/S, where the latter, however, has the advantage that the adjustment is continuously variable and yields before pushes and thrusts. A solution where the operation is exclusively done via PC has proven not to be optimum in practice. Typically a separate control panel is desired, so that the table can be operated independent of the PC. A positioning of the control panel on the table top, whether it is secured to or inlayed in the top side of the table top, has turned out also to have its disadvantages. From EP 1 470 766 A1 to Walter Koch (LogicData) is known a control panel with touch keys in a U-shaped housing placed over the edge of the table top and having a key both in the part of the housing on the top side of the table top and on the part under this. The price pressure on height adjustable tables causes the solution to be simple and functional, but may simultaneously convey to a design characteristic to the table, alternatively be completely neutral.

The object of the invention is to provide a simple, user-friendly and easy-to-mount control panel.

SUMMARY OF THE INVENTION

This is achieved according to the invention by employing a control panel based on touch keys placed on an element in the piece of furniture, as the element has an accessible preferably visible surface. On the accessible surface an indication of the touch keys are made. When touching an indication, the touch key belonging to it is activated. The term touch keys here denotes electric switches without electromechanical components or requirement for mechanical influence in order to create electrical contact, for instance capacitive touch keys, which in addition can be designated touch electrodes or touch antennas. One can distinguish between physical electrodes, called touch keys, and the virtual keys, for instance painted on, which serve for indication of the position of the touch keys incorporated in the element. If the element in the furniture in question is too thick to activate the touch key unambiguously or at all, the touch keys may be inlayed in a groove. For instance, on table tops the touch keys may be inlayed in a groove intended for the same. Provided that the groove is underneath the table top, there are no specific demands for finish and the top side of the table top remains intact. The groove can also be implemented against the edge of the table top and the touch keys placed at the edge and the indications belonging thereto placed on the edge. As the touch keys are operated on the top side of the table top, it gives the advantages of always having a firm pressure on the key as opposed to the operation panel according to EP 1 470 766 A1 to Walter Koch (LogicData) where the key is operated on the underside of the table top in order to make it move upwards. Hereby, it is easy to loose one's pressure on the key, as the table top keeps moving away from the finger.

In another embodiment, the touch keys and the connections belonging thereto can be inserted directly into the table top during the manufacturing of the same. One could envisage that the print with the touch keys and connections belonging to it, typically a flexible print of foil type, forms part of the table top along with the rest of the veneer layers. The foil with the touch keys are in that way positioned internally in the element, completely surrounded by the furniture element, for example a table top, armrest for a armchair or side member of a bed. Alternatively, the print with touch keys is inserted in one or more readily defined recesses in the furniture element. In a special embodiment the recess can have both an entrance and an exit, so that a narrow part of the print or the foil can slide through the recess, while a wider part only partially can slide through the recess and be stopped with the touch keys placed in the desired position hidden internally in the table top. Here, it generally applies that the keys may be operated optionally from either the under or the upper side of the table top, but it is also possible to operate the keys from an edge of the table. When operating the keys from under the table top, the foil or painting on the underside of the table will have the further purpose of guiding the user to find the respective touch keys for operation of the table with his fingers.

In the solution where the touch keys are placed in a recess, the cover can be the printed circuit board on which the touch controller is mounted.

The fixing of the cover itself or of the printed circuit board, usually in the form screws, pins or the like retains the cover or the printed circuit board in position above the recess. Simultaneously the fastening means serves as antennas for the touch sensors and further connects electrically to the printed circuit board. Short connections to the sensors ensure a better mode of operation of the sensor system, so that when the controller is positioned immediately next to the touch keys, a sturdy function is ensured. Suitable electroconductive fastening means for the table are chosen, which typically will have a relatively large diameter and normally do not penetrate the element entirely. During the assembly process it is ensured that the fastening means fill out a possible predrilled hole completely without leaving air pockets.

Owing to design or technical reasons, it is possible to choose whether the fastening means should penetrate the element entirely or partially. This could be to implement a touch solution in a table top of metal or in a conventional table top of wood or plastic with a fixed metal plate. In that case the touch keys must be isolated from the electrical conducting parts in the element and are possibly mounted from the upper side of the table top.

The wire connection connecting the sensor module to the control box for the actuators can either be guided in a recess in the table top or alternatively branch directly off from the cover or the printed circuit board via a strain relief for rapid and exact assembly and service.

The indications can in its most simple form be painted directly on the surface or be an affixed foil with indications. In a more sophisticated manner, it can be inlayed symbols for instance of another type of wood, metal plastic, etc. In principle it can also be an inlayed plate of glass, wood, metal, plastic, etc., with symbols.

Even though the above description mainly refers to tables, it of course also applies to armchairs, where the touch keys can be located in an armrest or on the outside. As far as beds or other laying furniture goes, the touch keys can be placed in an outer frame, alternatively on an adjustable support carrying the mattress.

Figure 2:
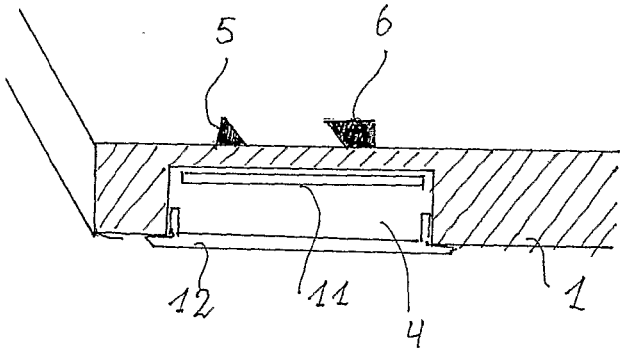
Figure 3:
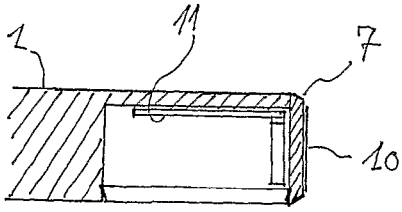
Figure 4:
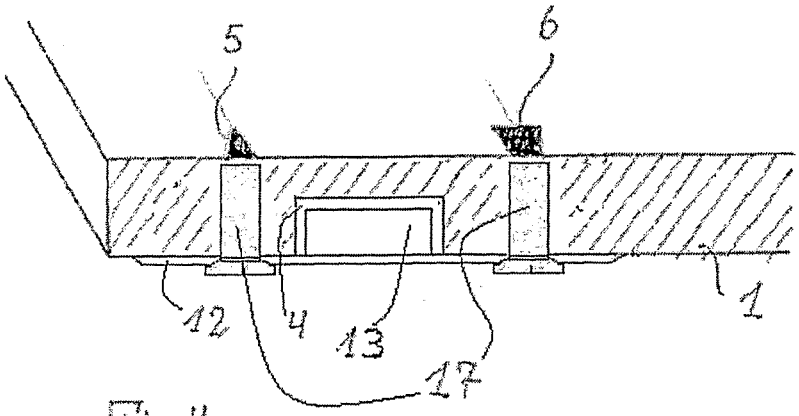
Figure 5:
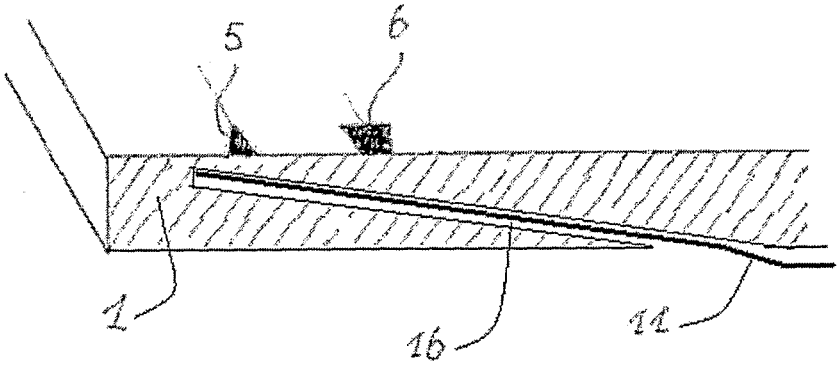
Figure 6:
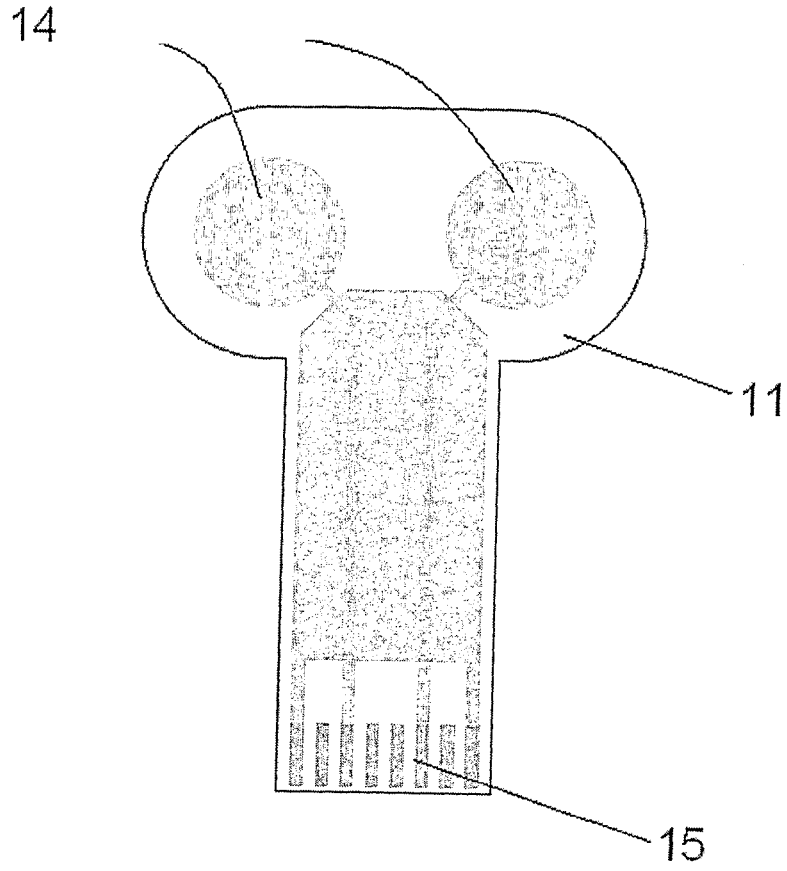
Figure 7:
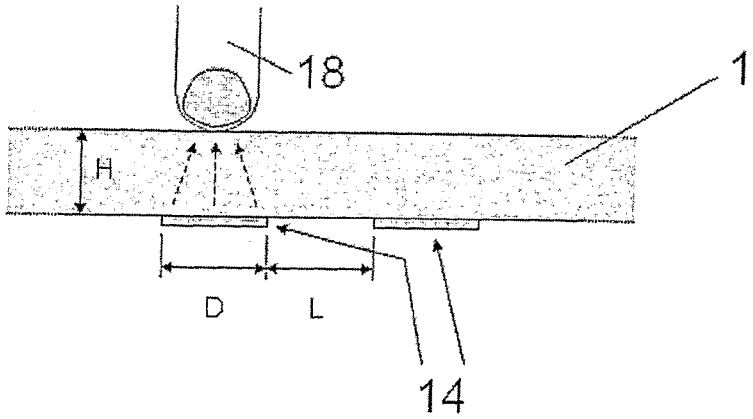

The invention will be explained more fully below with reference to the embodiment of a height adjustable sitting/standing table shown in the accompanying drawing, in which:

FIG. 1 shows a sketch of a height adjustable table seen from the point of view of the user, FIG. 2 shows a section in the table top as seen along line II-II in FIG. 1, FIG. 3 shown another section in the table top following as seen along III-III in FIG. 1, FIG. 4 shows a section in the table top for description of the touch system executed in a manner partially penetrating the table top, FIG. 5 shows a section in the table top describing the touch keys inlayed hidden in a recess in the table top, FIG. 6 shows an example of a foil print with touch keys, and FIG. 7 shows an example of a control of the touch keys hidden under the table top.

The table outlined in FIG. 1 comprises a table top 1, which in each side is carried by two lifting columns 2*a*, 2*b*, as mentioned in WO 03/003876 A1 to Linak A/S. The lower end of each of the lifting columns is mounted with a foot. A control box 3 that includes a net based power supply and a control unit is located under the table top, shown transparent.

The control connected to the control unit is based on touch keys mounted on a printed circuit board 11, and in a first embodiment, as indicated to the left in FIG. 1 and in FIG. 2, the print with touch keys 14 is inlayed in a groove 4 on the underside of the table top 1. After assembly of the touch keys, the groove can be closed with a cover 12. The groove is so deep that only a thin layer of material, normally wood, covers the touch keys, so that an unambiguous activation of the touch keys is achieved. In order to prevent air pockets between the touch keys and the surrounding material, the touch keys can be mounted with glue, paste, gel or another material capable of filling a cavity and ensuring that the touch keys are held in their position. Proper consideration must be shown for electric isolation between table top and touch keys, if the table top is made of or partially contains an electroconductive material. Above the touch keys, two arrow symbols 5,6 are painted directly onto the top side of the table top. When touching one arrow symbol 6, the touch key is activated for lowering the table, while when touching the other arrow symbol 5, the other touch key is activated for raising the table top. To be accurate, the columns are activated through the control unit for contracting or expanding so that the table top is raised or lowered respectively.

In another embodiment indicated to the right in FIG. 1 and FIG. 3, the groove is implemented against the edge 7 of the table top and the touch keys are located on the printed circuit board, so that they are facing the edge. The indications in the form of arrow symbols 8,9, here in the form of the adhesive foil 10, are applied to the edge, so that the symbols are positioned just outside the touch keys.

An alternative embodiment of the solution with the groove is shown in FIG. 4 where a cover 12 is the printed circuit board with the electronics for the touch function, consisting of a touch controller and discrete electronic components, here shown in the drawing protected by an insulating box 13 mounted over the components. The size of the groove or the cavity is determined by the volume of the electronics. The fastening means 17 penetrate partly through the table top 1 where the fastening means in the figure are shown as non-penetrative of the table top. The fastening means could, however, also penetrate the table top and be inserted from above instead of being mounted from the back of the table top so that they appear hidden. The fastening means 17 holding the cover 12 and forming electrical contact with the touch controller thus functions as antennas or touch keys. The indications 5 and 6 only serve to indicate the positions of the touch field on the table top. The solution also provides possibility for operation of the table by touching the fastening means 17 under the table.

FIG. 5 shows the touch keys 11 inlayed in a recess 16 in the piece of furniture immediately under the indications 5,6 on the table top 1. Here it is shown as a recess, emerging from under the table top, but the recess might as well be placed on the front edge of the table and be hidden by a cover or a strip.

FIG. 6 shows an example of a print 11, which can be constructed on a flexible piece of print. It consists of laminated foil with electroconductive connections. The touch keys 14 are connected to the plug connections 15 for connection with the touch controller. The plug connection 15 can either be connected to a plug or be a male part in a plug connection. The plug connection can of course also be connected by means of traditional connection methods such as soldering, wrapping, etc.

FIG. 7 shows the typical structure of the touch system.

The above only mentions two keys, but more keys for exercising more functions, for instance storing of various positions of the table, may of course be provided.

It generally applies that the touch keys can be mounted with gel, glue or another material, capable of filling out a possible cavity with due regard to the electric isolation of the touch keys.

The invention claimed is:

1. An electrically adjustable piece of furniture, comprising:

at least one motorized lifting column for adjustment of the piece of furniture, an element having a top side and a back side, said back side including a groove therein, at least one controller that includes capacitive touch keys inlayed in said groove in the back side of the element, a printed circuit board which covers the groove, and means forming indications on the top side of said element above the capacitive touch keys as operation keys for activating said capacitive touch keys.

2. The piece of furniture according to claim 1, wherein the element defines an edge and the groove extends inwardly from the edge.

3. The piece of furniture according to claim 1, wherein the means forming indications is located on one or more surfaces of the element.

4. The piece of furniture according to claim 1, wherein the touch keys are held in position by means of glue, gel or paste.

5. The piece of furniture according to claim 1, wherein the printed circuit board is mounted on the element with fastening means in the form of screws or pins which serve partly as antennas for the touch keys and partly as electroconductive connection to the touch keys.

6. The piece of furniture according to claim 5, wherein the fastening means do not completely penetrate the element.

7. The piece of furniture according to claim 5, wherein the fastening means penetrate the element and are electrically insulated from electroconductive parts of the element.

8. The piece of furniture according to claim 1, wherein the means forming indications comprises an adhesive foil.

9. The piece of furniture according to claim 1, wherein the means forming indications comprises symbols.

10. The piece of furniture according to claim 1, wherein the means forming indications comprises an inlayed glass plate.

11. The piece of furniture according to claim 1, wherein the means forming indications comprises touch fields on a plate of glass, wood, metal or plastic.

12. An electrically-adjustable piece of furniture, comprising:

at least one motorized lifting column for adjustment of the piece of furniture;

an element having a top side, a back side and a recess in the back side, and at least one controller that includes a printed circuit board which fits into the recess and against a stop therein, capacitive touch keys electrically connected to a connection field usable directly in a plug connection or in connection with a plug, said stop positioning the touch keys in the recess as desired, and means forming indications on the top side of the element above the capacitive touch keys as operation keys for activating the capacitive touch keys.

* * * * *